US005273115A

United States Patent [19]

Spafford

[11] Patent Number: 5,273,115

[45] Date of Patent: Dec. 28, 1993

[54] METHOD FOR REFRACTURING ZONES IN HYDROCARBON-PRODUCING WELLS

[75] Inventor: Stephen D. Spafford, Pleasant Grove, Ala.

[73] Assignee: Gas Research Institute, Chicago, Ill.

[21] Appl. No.: 912,870

[22] Filed: Jul. 13, 1992

[51] Int. Cl.[5] ..... E21B 43/26

[52] U.S. Cl. ..... 166/281; 166/297; 166/308

[58] Field of Search ..... 166/281, 297, 308

[56] References Cited

U.S. PATENT DOCUMENTS

| | | | |
|---|---|---|---|
| 3,419,070 | 12/1968 | Ernst | 166/281 X |
| 3,431,977 | 3/1969 | East et al. | 166/281 |
| 3,537,529 | 11/1970 | Timmerman | 166/281 X |
| 3,830,299 | 8/1974 | Thomeer | 166/281 X |
| 3,987,850 | 10/1976 | Fitch | 166/280 X |
| 4,665,990 | 5/1987 | Perlman | 166/307 |
| 4,750,562 | 6/1988 | Jennings, Jr. | 166/281 |
| 4,993,491 | 2/1991 | Palmer et al. | 166/280 |
| 5,111,881 | 5/1992 | Soliman et al. | 166/281 X |
| 5,181,568 | 1/1993 | McKown et al. | 166/295 X |

OTHER PUBLICATIONS

M. W. Conway, et al., "Expanding Recoverable Reserves Through Refracturing," SPE 14376, Society of Petroleum Engineers, 1985.

N. R. Warpinski, et al., "Altered-Stress Fracturing," SPE 17533, Society of Petroleum Engineers, presented at SPE Rocky Mountain Meeting held in Casper, Wyoming, May 11-13, 1988.

*Primary Examiner*—George A. Suchfield

*Attorney, Agent, or Firm*—Pravel, Hewitt, Kimball & Krieger

[57] ABSTRACT

A method is provided for refracturing a well which has previously been hydraulically fractured in a lower zone or in the same zone. A sealing material is injected and allowed to solidify, the well is reperforated and refractured.

12 Claims, 2 Drawing Sheets

METHOD FOR REFRACTURING ZONES IN HYDROCARBON-PRODUCING WELLS

FIELD OF THE INVENTION

This invention pertains to a novel method of stimulating the production rate of hydrocarbons from wells. More particularly, a method is provided for refracturing a hydrocarbon-bearing zone when a lower zone or the same zone has been previously hydraulically fractured.

BACKGROUND OF THE INVENTION

Hydraulic fracturing is commonly used to stimulate the production rate from subterranean wells. Fractures formed from fluid injection into the wells extend in a direction determined by stresses in the earth around the well. The fractures propagate in a direction normal to the minimum stress. At sufficient depth in the earth, the stress in the vertical direction is great enough to cause the fractures formed around wells by hydraulic pressure to be formed in a vertical direction in the earth.

The limit to vertical growth of such fractures is normally determined by an increase in horizontal stress or a change in mechanical properties in some strata in the earth. There is no known method to insure that a vertical fracture will not extend over a greater vertical interval than the subterranean zone which is to be stimulated in production rate by hydraulic fracturing, although some design variables can be selected to minimize the likelihood of "fracturing out of zone" in a hydraulic fracturing treatment. Models to predict the growth of vertical fractures are discussed at length in *Recent Advances in Hydraulic Fracturing*, SPE Monograph Vol. 12, Soc. of Pet. Engrs., Richardson, Tex., 1989, Chaps. 3, 4 and 5.

It is not unusual for multiple zones or beds penetrated by one well to be hydraulically fractured. The separate zones may be fractured simultaneously by having access from the wellbore, or they may be fractured sequentially by "stages," each stage isolating one segment of the wellbore and injecting fluids in the normal method. The separate stages are normally applied sequentially from the deeper to the shallower depths in a well. There is a question in such wells as to the vertical extent of the fracture formed in each stage. If the fracture from a stage applied deeper in the well influences a fracture formed in a shallower stage, the length of the fracture formed in the shallower stage is likely to be much shorter than expected. This may be caused by the much larger area for leak-off of fluid from the fracture and the possibility that zones having lower earth stress are contacted by the existing fracture.

Techniques have been developed in recent years to recover coal bed hydrocarbon gas from coal deposits. The gas, primarily methane, is produced by drilling wells and decreasing pressure in the coal to cause the methane to flow from the coal. Hydraulic fracturing has proven very helpful in increasing the production rate of the coal bed gas. Special techniques have been disclosed for forming and propping the fractures. U.S. Pat. No. 4,993,491 pertains to a method of injecting a range of sizes of proppant particles in a fracture in a coal bed. U.S. Pat. No. 4,665,990 discloses a method of alternating injection of fracturing fluid containing fine proppants and acidizing solution to fracture a subsurface coal formation.

There is a need for a method to increase the effectiveness of fractures when the initial fracture in a zone is improperly placed. Improper placement could be caused by stress not accounted for in the initial design or the influence of stimulations in other zones in the wellbore.

SUMMARY OF THE INVENTION

In one embodiment, there is provided a method to refracture a zone containing hydrocarbons which has an underlying zone which has also been previously fractured by setting a plugging means in the casing below the zone to be refractured, injecting a sealing material through perforations into the upper zone and allowing solidification, reperforating the upper zone and refracturing. In another embodiment, the zone to be refractured is a coal bed containing coal bed methane which is to be recovered through a well. In yet another embodiment, a single zone containing hydrocarbons which has been previously fractured is refractured after injecting a sealing material through perforations into the zone, allowing solidification, reperforating the zone and refracturing.

DETAILED DESCRIPTION OF PREFERRED EMBODIMENT

Figure 1:
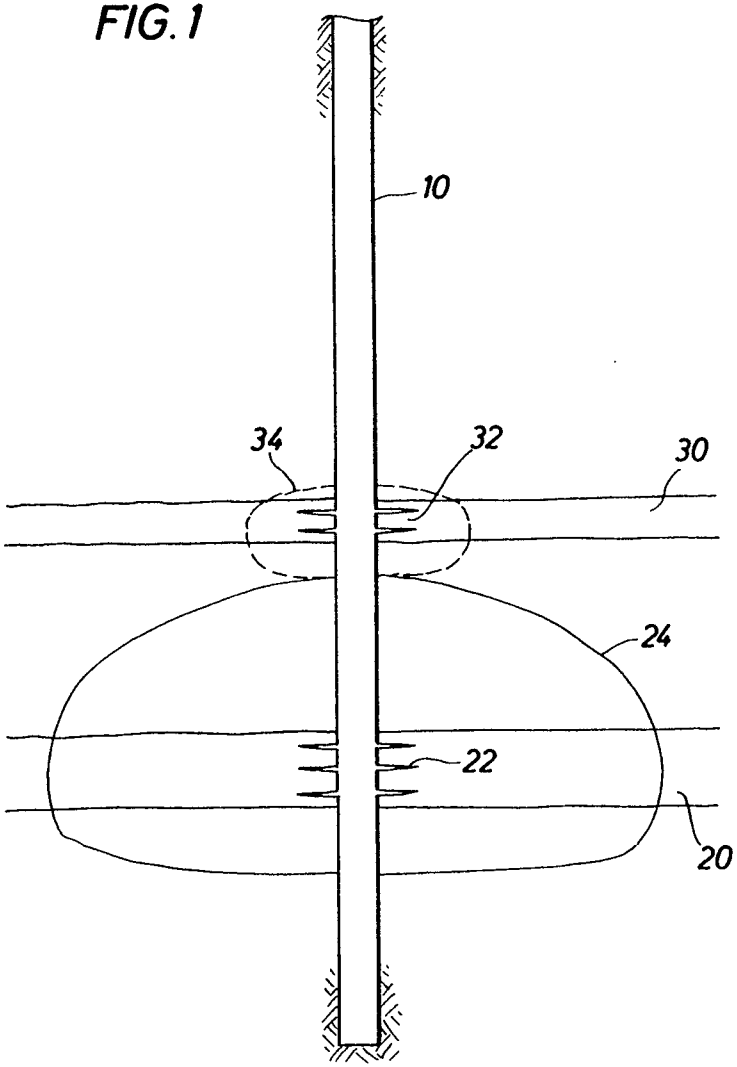
FIG. 1 is a cross-section of two zones separated in a cased wellbore, both zones having been hydraulically fractured.

Referring to FIG. 1, casing 10 in a well is shown. Casing 10 will normally be cemented in a wellbore (not shown). Casing 10 has been perforated into two zones 20 and 30. Perforations 22 have been formed into zone 20 and perforations 32 have been formed into zone 30. Zone 20 has been hydraulically fractured, the limits of the hydraulic fracture extending out of zone 20 to the zone enclosed within 24. Likewise, a hydraulic fracturing treatment has been applied to zone 30, but the extent of this fracture has been limited to the line 34 because the previous fracture influenced the new fracture by some means, for example, either because it intersected pre-existing line 24 or changes in stress caused by the fracture within line 24 limited fracture growth. Fracturing fluid from the zone within the line 34 may have entered the previously existing fracture, which prevents growth of the fracture in zone 30, where fracturing is designed to increase the production rate of the upper zone. A much shorter fracture is obtained in zone 30, which is well-known to result in a lower production rate from zone 30.

Figure 2:
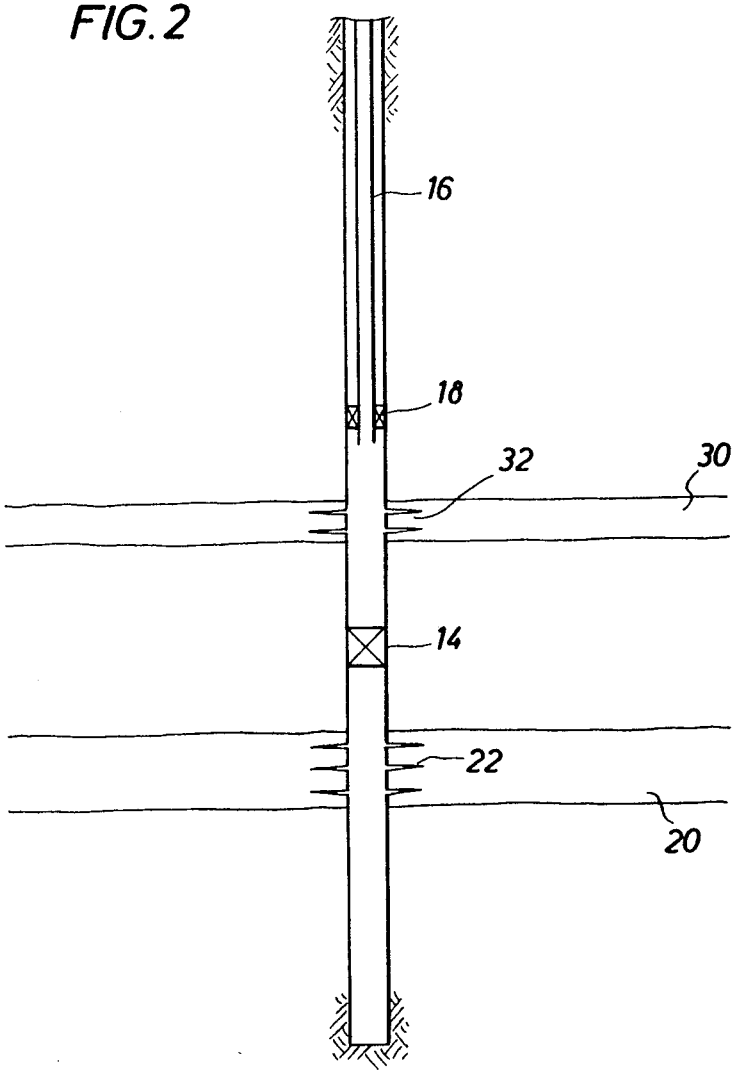
FIG. 2 is a cross-section of the two zones and the wellbore equipped for injecting a sealing material into the upper perforations.

In accord with one embodiment of this invention, zone 30 is to be refractured to form a more effective stimulation of production from this zone. Referring to FIG. 2, preventing flow within the casing between zone 20 and zone 30 is first placed. This means may normally be a conventional bridge plug, 14 which can be set by wire line or tubing below zone 30 and above zone 20.

Other means of isolating flow, such as cement plugs or gel plugs may also be employed. A bridge plug will preferably be retrievable. Tubing 16 having packer 18 attached thereto is placed in the well. Then packer 18, such as an "EZSV" packer, which is shear-set and drillable, is set above the upper perforations with tubing extending to the wellhead (not shown). Injection of fluid is established down the tubing and through perforations 32 and a sealing solution is then injected. In one embodiment, a water soluble or dispersible solution such as a sodium silicate solution which cross-links to solidify is injected. An example of such solution is "INJECTROL-G", available from Halliburton Company. This solution is used to penetrate any fracture channels which are too narrow for cement penetration. Volumes from 100 gallons to 10,000 gallons may be employed, but preferably volumes from 500 gallons to 2,000 gallons are injected at a pressure below fracturing pressure of the well. Other sealing solutions may be used which contain water soluble polymers which cross-link with a delayed action to become extremely high viscosity fluids or solid materials. Preferably, the sealing solution has a density greater than water. Sufficient time is allowed for the injected solution to solidify. In the preferred embodiment, a cement slurry to act as a second sealing solution is injected after the initial sealing solution is injected. A small fresh-water spacer may be used between the two fluids. Any cement slurry may be used, but the cement slurry is preferably made of a fine-grained cement designed small fractures, such as Halliburton's "MICROMATRIX" cement. The cement slurry should have a density greater than water. Then sufficient time is allowed for the cement to set. Care is taken to avoid over-flushing of the cement through the perforation when it is displaced down the wellbore with water. It will then be necessary normally to drill the cement from the wellbore and allow access to the zone to be refractured. Zone 30 then is perforated again using conventional perforating means. The new perforations can be in the same zone, above the zone or in the same interval as the original perforations.

Figure 3:
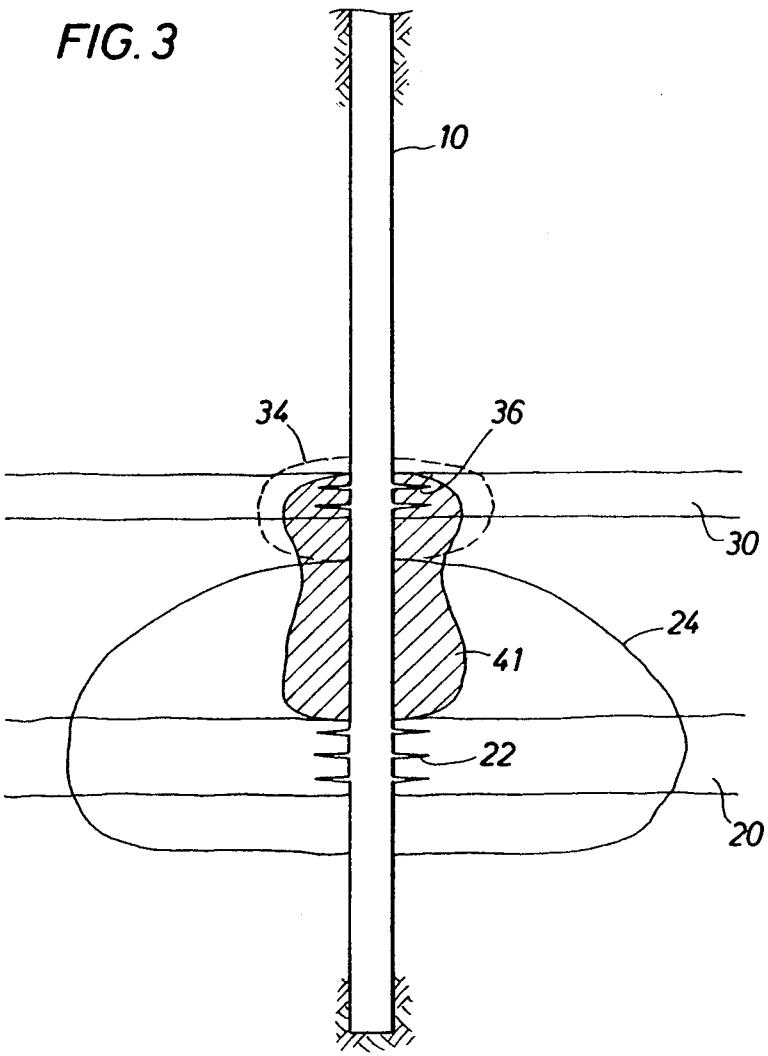
FIG. 3 is a cross-section of the two zones after a sealing material has been injected into the upper perforations.

FIG. 3 illustrates the distribution of the sealing solution or sealing solutions 41 after the solutions have solidified in pre-existing fractures and zone 30 has been reperforated. New perforations 36 now exist which may be in the same interval as previous perforations 32, now plugged with sealing material.

The restimulation of zone 30 is of conventional design normally, but particular design considerations may be important depending upon the characteristics of zone 30. If zone 30 is a coal bed which has been depleted, foam will be particularly advantageous as a fracturing fluid to re-pressure the formation and reduce the risk of water-block damage by minimizing the volume of water re-introduced into the coal bed. If the coal bed contains natural fractures, which is common, the low leak-off characteristics of foam maximize proper placement in the coal bed. Non-damaging aspects of foam and water soluble polymers which leave little residue in the fracture are also advantageous. Other fracturing fluids such as linear gels, (gels which are not crosslinked) crosslinked gels, water, oil or emulsion can also be used.

Figure 4:
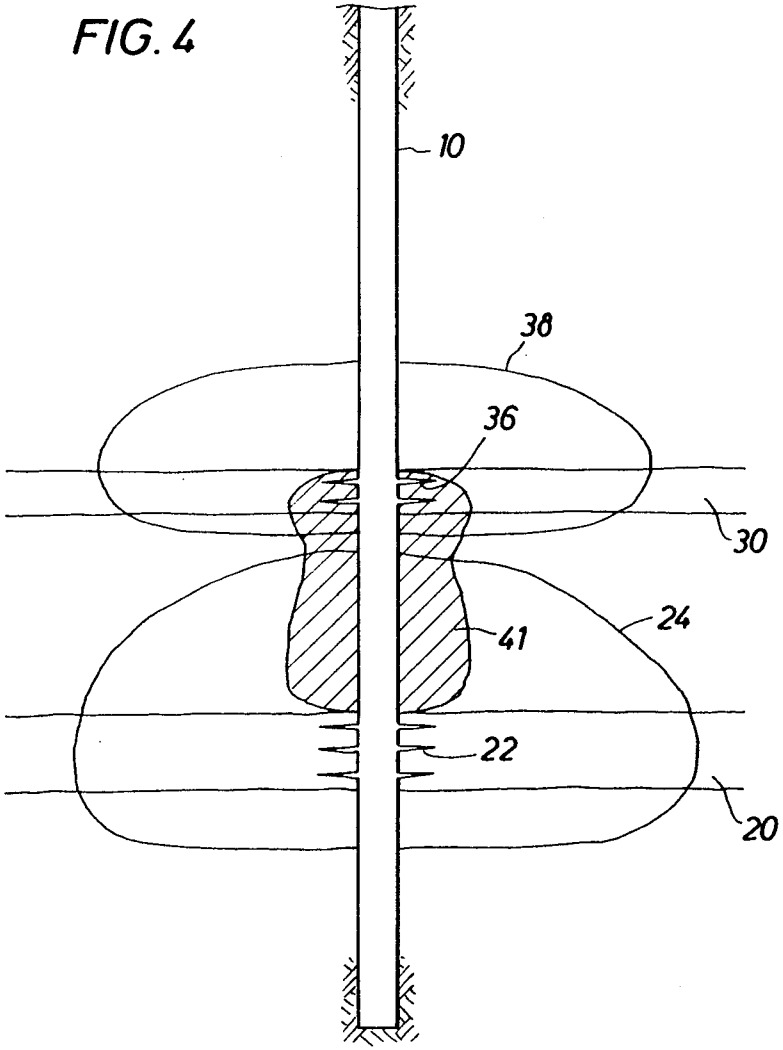
FIG. 4 is a cross-section of the two zones after the upper zone has been refractured in accord with this invention.

FIG. 4 illustrates the fracture which is formed in zone 30 after the refracturing treatment. The fracture now extends to the line 38, which makes possible much greater stimulation of production from the zone than was possible with the shorter fracture shown in FIG. 3. Sealing material 41 present in the original fractures has prevented influencing the new fracture from the lower zone and has allowed growth of the fracture in the lateral direction to the line 38.

The method described above by reference to FIGS. 3 an 4 is also applicable to refracturing a single zone. Referring to FIG. 2, if the lower fracture within line 24 does not exist or zone 20 does not exist and a fracture has been created as within line 34, such fracture being of insufficient length to have the desired effectiveness, the invention provides a method to increase the effectiveness of the hydraulic fracture in the single zone. The sealing solution or solutions are injected through the perforations into the zone and allowed to solidify, the zone is reperforated and then refractured. Sealing of existing induced or natural fractures and change in the stress field around the well can allow a more effective fracture to be formed during refracturing.

EXAMPLE

A well was drilled in the Black Warrior Basin in Alabama to penetrate the multiple coal seams containing methane. The well was cased and perforated in zones of the Blue Creek Group and the underlying Black Creek Group, with six coal seams perforated in the Black Creek Group and one in the Blue Creek Group. A three-stage fracturing treatment was applied to six zones of the Black Creek Group, all of which underlie the Blue Creek zones. Then a separate treatment was applied to an upper Blue Creek Zone, which lies about 150 feet above the nearest underlying Black Creek zone. When production from the well was lower than expected from comparison to offset well production, tests were performed by setting a packer between the upper and lower groups of coal beds. The tests indicated that communication existed in the reservoir between these zones. It was suspected that the fracture from the upper Blue Creek zones was not effective because it had been influenced by the fracture from the lower zones which had grown upward during fracturing treatments of the lower zones.

The treatment to refracture the well began with removal of rods, pump and tubing from the well. A retrievable bridge plug was set below the Blue Creek perforations. A packer (EZSV) with a tubing stinger was set 30 feet above the Blue Creek perforations, with the tubing extending to the surface. A two-barrel fresh-water spear head was injected through the tubing into the Blue Creek perforations to clean the tubing and flow path. Then "INJECTROL-G" (sodium silicate) with "MF-1" activator was injected to penetrate fracture channels This fluid had a viscosity of 1.5 cp and a density of 9.1 ppg. One thousand gallons was injected at 0.5 barrels per minute down the tubing. After 90 minutes, tests showed that the activator causes the viscosity to increase to 500,000 cp. Brine also causes the fluid to set or become extremely viscous. Then a two-barrel fresh-water spacer was injected at 0.5 barrels per minute. This was followed by 422 gallons of Halliburton's "MICROMATRIX" cement with a 2% KCL accelerator. The density of this fluid was 11.5 pounds per gallon. It was injected at 0.5 barrels per minute. This cement was displaced with water to the perforations, but over-flushing was avoided. Forty-eight hours was allowed for the cement to set and it was then drilled out to the top of the bridge plug. The upper Blue Creek seam was reperforated.

The refracturing was performed using nitrogen foam as the fluid. The aqueous phase of the foam contained 30 pounds per 1,000 gallons of HEC polymer. A pad volume of 40,000 gallons of foam was pumped at 35 barrels per minute, then increasing proppant concentrations were added to the foam until 100,000 gallons of foam was injected along with 186,000 pounds of proppant. The proppant was 16/30 mesh sand. Proppant concentrations increased in stages from 1 pound per gallon to 5 pounds per gallon.

Before the restimulation, the well was producing at rates of 65,000 cubic feet per day and 21 barrels of water per day from the combined Blue Creek and Black Creek groups. Testing of individual zones indicated that the upper Blue Creek Group was contributing about 50,000 cubic feet per day of this total. After restimulation, gas production from the well peaked at 380,000 cubic feet per day with water production of 48 barrels per day. Several months after restimulation, the well was still producing over 350,000 cubic feet per day and the water rate had declined to 39 barrels per day.

This invention has been described with reference to its preferred embodiment. Those of ordinary skill in the art may, upon reading this disclosure, appreciate changes or modifications which do not depart from the scope and spirit of the invention as described above or claimed hereafter.

What is claimed is:

1. A method of refracturing a subterranean hydrocarbon-bearing zone, the zone being connected to a wellbore through perforations in casing of a well and separated from an underlying permeable zone, the underlying zone also being connected through perforations in casing of the well and having been previously hydraulically fractured from the well, comprising:

(a) placing means for preventing flow in the casing of the well below the zone to be refractured and above the underlying zone;

(b) injecting a sealing material through perforations into the zone to be refractured and allowing the sealing material to become solid;

(c) reperforating the zone to be refractured; and (d) refracturing the zone through the perforations.

2. The method of claim 1 wherein the means for preventing flow of step (a) is a bridge plug.

3. The method of claim 1 wherein the sealing material is a cement slurry.

4. The method of claim 1 wherein the sealing material is a solution of cross-linkable polymeric material.

5. The method of claim 4 additionally comprising the step of injecting a cement slurry after injection of the cross-linkable polymeric material and before step (c).

6. The method of claim 1 wherein the refracturing of step (d) is comprised of injection of fracturing fluid selected from the group of fracturing fluids consisting of foam, linear gels, crosslinked gels, emulsion, water and oil, the fracturing fluid containing a propping material.

7. A method of refracturing a subterranean coal bed, the coal bed being connected to a wellbore through perforations in the casing of a well and separated from an underlying permeable zone, the underlying zone also being connected through perforations in the casing of the well and having been previously hydraulically fractured from the well, comprising:

(a) placing means for preventing flow in the wellbore of the well below the coal bed to be refractured and above the underlying zone;

(b) injecting a sealing material through perforations into the coal bed to be refractured and allowing the sealing material to solidify;

(c) reperforating the coal bed to be refractured; and (d) refracturing the coal bed through the perforations.

8. The method of claim 7 wherein the means for preventing flow of step (a) is a bridge plug.

9. The method of claim 7 wherein the sealing material is a cement slurry.

10. The method of claim 7 wherein the sealing material is a solution of cross-linkable polymeric material.

11. The method of claim 10 additionally comprising the step of injecting a cement slurry after injection of the cross-linkable polymeric material and before step (c).

12. The method of claim 7 wherein the refracturing of step (d) is comprised of injection of a fracturing fluid selected from the group of fracturing fluids consisting of foam, linear gels, crosslinked gels, emulsion, water and oil, the fracturing fluid containing a propping material.

* * * * *

UNITED STATES PATENT AND TRADEMARK OFFICE

CERTIFICATE OF CORRECTION

PATENT NO. : 5,273,115

DATED : DECEMBER 28, 1993

INVENTOR(S) : STEPHEN D. SPAFFORD

It is certified that error appears in the above-identified patent and that said Letters Patent is hereby corrected as shown below:

At column 2, line 65, insert --a means of-- after "Fig. 2,".

At column 2, line 67, change "plug, 14" to --plug 14,--.

At column 3, line 30, insert --to penetrate-- after "designed".

At column 4, line 51, insert --.-- after "channels".

Signed and Sealed this

Thirty-first Day of May, 1994

Bruce Lehman

*Attest:*

BRUCE LEHMAN

*Attesting Officer*

*Commissioner of Patents and Trademarks*